US005628094A

United States Patent [19]

Mizuno

[11] Patent Number: 5,628,094

[45] Date of Patent: May 13, 1997

[54] LOCK SLIDER FOR SLIDE FASTENER

[75] Inventor: Hiroshi Mizuno, Toyama-ken, Japan

[73] Assignee: YKK corporation, Tokyo, Japan

[21] Appl. No.: 686,585

[22] Filed: Jul. 26, 1996

[30] Foreign Application Priority Data

Jul. 31, 1995 [JP] Japan ..... 7-194519

[51] Int. Cl.[6] ..... A44B 19/00

[52] U.S. Cl. ..... 24/423; 24/419; 24/428; 24/429

[58] Field of Search ..... 24/423, 424, 425, 24/428, 429, 419, 430, 432

[56] References Cited

U.S. PATENT DOCUMENTS

| | | | |
|---|---|---|---|
| 3,872,553 | 3/1975 | Moertel | 24/428 |
| 3,874,040 | 4/1975 | Murakami | 24/419 |
| 4,562,622 | 1/1986 | Takabatake | 24/428 |
| 4,590,648 | 5/1986 | Yoshida et al. | 24/428 |

*Primary Examiner*—Victor N. Sakran
*Attorney, Agent, or Firm*—Hill, Steadman & Simpson

[57] ABSTRACT

A lock slider, for a slide fastener, includes an upper wing having an interior surface adapted to be in contact with a pair of fastener tapes, and a wedge-like ridge projecting from the interior surface of the upper wing and extending from a guide post toward a rear end of the upper wing for spreading open the respective closely abutting inner longitudinal edges of the fastener tapes. A tapering fore end portion and a rectangular stem of the ridge has a sharp edge. The upper wing further has, in its interior surface, a recessed portion extending around the fore end portion and the stem for for allowing the inner longitudinal tape edges to be displaced into the recessed portion when they are spread open by the ridge. An aperture for the passage of a locking pawl is formed in the upper wing at an intermediate portion of the ridge. By virtue of the combination of the ridge and the aperture, the abutting inner longitudinal tape edges are sufficiently spread open, and the locking pawl comes into locking engagement with the fastener elements inside the slider without interference with the tape edges.

17 Claims, 6 Drawing Sheets

LOCK SLIDER FOR SLIDE FASTENER

BACKGROUND OF THE INVENTION

1. Field of the Invention

The present invention relates generally to a lock slider for a slide fastener of the type including a mechanism capable of manually or automatically locking the slider in position on a slide fastener, and more particularly to such a lock slider which is particularly suitable for use in a slide fastener of the so-called "concealed" type including fastener tapes used with their fastener element attaching portions being disposed on a backside of a garment.

2. Description of the Prior Art

One known lock slider for a slide fastener of the type is disclosed in Japanese Utility Model Publication No. SHO 63-5533. As shown in FIG. 7, the disclosed lock slider includes a land 20 projecting centrally from the interior surface of an upper wing 5' and extending longitudinally from a guide post 7' toward a rear end 8' of the upper wing 5' for forcing down fastener elements of the slide fastener, and an aperture 13' located at one side of the land 20 for the passage therethrough of a locking pawl.

FIG. 8 shows another known lock slider disclosed in Japanese Patent Laid-open Publication No. HEI 5-305001. The disclosed lock slider is used in a concealed slide fastener and includes a straight ridge 21 of a semi-circular cross-section projecting centrally from the interior surface of an upper wing 5' and extending longitudinally from a guide post 7' toward a rear end of the upper wing 5' for forcing down fastener elements E of the fastener, a pair of lands 22, 22 disposed one on each side of the ridge 21 for pressure engagement with the front side of fastener tapes T to which the fastener elements E are attached by sewing threads S, and an aperture 13' located at an intermediate portion of the lands 22 and the ridge 21 for the passage therethrough of a locking pawl 4'.

Still another example of known lock slider, disclosed in Japanese Patent Laid-open Publication No. SHO 58-7203, includes, as shown here in FIG. 9, a ridge 23 projecting centrally from the interior surface of a planar lower wing 6' and extending longitudinally from the guide post 7' toward a rear end of the lower wing 6', and a pair of furrows 24, 24 disposed one on each side of the ridge 23 for allowing coupling elements E and inner longitudinal tape edge portions to be displaced into the furrows 24 so as to facilitate correction of longitudinal mismatch of opposite fastener tapes T.

The first-mentioned known lock slide-fastener slider has a drawback that the land 20 provided for forcing down the fastener elements and not for spreading open the inner longitudinal edges of the fastener tapes. Therefore, since a peripheral edge of the land 20 is beveled or rounded, the land 20 can readily allow the fastener tapes to lean over the land 20. Thus, the land 20 cannot perform a sufficient spreading of the closely abutting inner longitudinal edges of the fastener tapes. Another drawback is that since the aperture 13' is laterally off the land 20, the locking pawl can not have interlocking engagement with the fastener elements reliably, failing to achieve the prescribed locking function.

According to the second-mentioned known lock slide-fastener slider, the ridge 21 for forcing down the fastener elements E is disposed on the interior surface of the upper wing and extending longitudinally of the upper wing 5', and the lands 22 adapted to be pressed against the front side of the fastener tapes T are disposed on opposite sides of the ridge 21. The lock slider thus constructed also has no function of spreading open the closely abutting inner longitudinal edges of the fastener tapes T and hence the locking pawl 4' is unable to engage with the fastener elements E reliably and an effectual locking function cannot be performed.

In the third-mentioned known lock slide-fastener slider, the furrows 24 are provided in the interior surface of the lower wing 6' on opposite sides of the central ridge 23 for facilitating correction of longitudinal deviation or mismatch of the opposite fastener stringers of the slide fastener. In order to release interlocking engagement between the opposite rows of fastener elements E, the furrows 24 must provide a great space. Therefore, this construction cannot be applied to a slider of the type wherein a locking pawl has interlocking engagement with the fastener elements E while spreading open the closely abutting inner longitudinal edges of the fastener tapes T.

SUMMARY OF THE INVENTION

With the foregoing drawbacks in view, an object of the present invention is to provide a lock slider, for slide fasteners, which is capable of spreading open the closed or abutting inner longitudinal edges of a pair of fastener tapes inside the slider for enabling a locking pawl to operate reliably to perform an effectual locking function.

Another object of the present invention is to provide a lock slide-fastener slider including a wedge-shaped ridge of a particular configuration disposed inside of the slider, which is able to secure a reliable spreading of the abutting inner longitudinal tape edges.

A further object of the present invention is to provide a lock slide-fastener slider having a structural feature which is capable of facilitating displacement of the abutting inner longitudinal edge portions of the fastener tapes to spread the inner longitudinal tape edges easily and reliably, so that the smooth spreading with low frictional resistance can be realized.

Still another object of the present invention is to provide a lock slide-fastener slider which is capable of guiding the fastener elements in stable condition within the slider while maintaining a reliable spreading of the inner longitudinal tape edges.

A further object of the present invention is to provide a lock slide-fastener slider having a recessed portion of a particular configuration which is capable of promoting the reliable and smooth displacement of the inner longitudinal tape edge portions and the smooth, low-frictional-resistance spreading of the inner longitudinal tape edges.

Another object of the present invention is to provide a lock slider having structural features enabling application of the slider to a concealed slide fastener.

According to the present invention there is provided a lock slider for a slide fastener having a pair of rows of fastener elements attached to one surface of a pair of fastener tapes along their respective inner longitudinal edges. The lock slider includes a slider body having a pair of parallel spaced upper and lower wings joined at their front end by a guide post so as to define a Y-shaped guide channel between said wings for the passage of the rows of the fastener elements of the slide fastener, and a locking pawl movable into and out of the guide channel through an aperture for interlocking engagement with the fastener elements to lock the slider in position on the slide fastener. One of the wings has an interior surface adapted to be in contact with the other surface of the fastener tapes. The slider body of the lock slider includes a wedge-like ridge projecting from the interior surface of the upper or lower wing and extending from the guide post toward a rear end of the upper or lower wing for spreading open the inner longitudinal edges of the fastener tapes. And the aperture for the passage of the locking pawl is located in the wedge-like ridge.

In one preferred form, the wedge-like ridge includes a tapering fore end portion and a rectangular stem having sharp edges and being capable to be inserted between the inner longitudinal edges of the fastener tapes.

Alternatively, the wedge-like ridge has a dovetail shape in transverse cross section and is capable of holding the inner longitudinal edges of the fastener tapes in a laterally spaced position as they are spread open by the wedge-like ridge.

Preferably, the slider is for use in a concealed type slide fastener, and the upper wing including the wedge-like ridge has flat opposite lateral edges free from flanges.

Also preferably, a pair of lands are provided contiguous to an end of the wedge-like ridge remote from the fore end portion and extending along opposite sides of the guide post for supporting and guiding the rows of the fastener elements, respectively, the lands being flush with the wedge-like ridge.

Further preferably, the upper or lower wing further has in the interior surface a recessed portion extending around the wedge-like ridge for allowing the inner longitudinal edges of the fastener tapes to be displaced in the recessed portion.

Preferably, the recessed portion extends from an inner end of the guide post to a rear end of the upper or lower wing.

The above and other objects, features and advantages of the present invention will become manifest to those versed in the art upon making reference to the detailed description and the accompanying sheets of drawings in which preferred structural embodiments incorporating the principles of the present invention are shown by way of illustrative examples.

DETAILED DESCRIPTION

Certain preferred embodiments of the present invention will be described below in greater detail with reference to the accompanying sheets of drawings.

Figure 1:
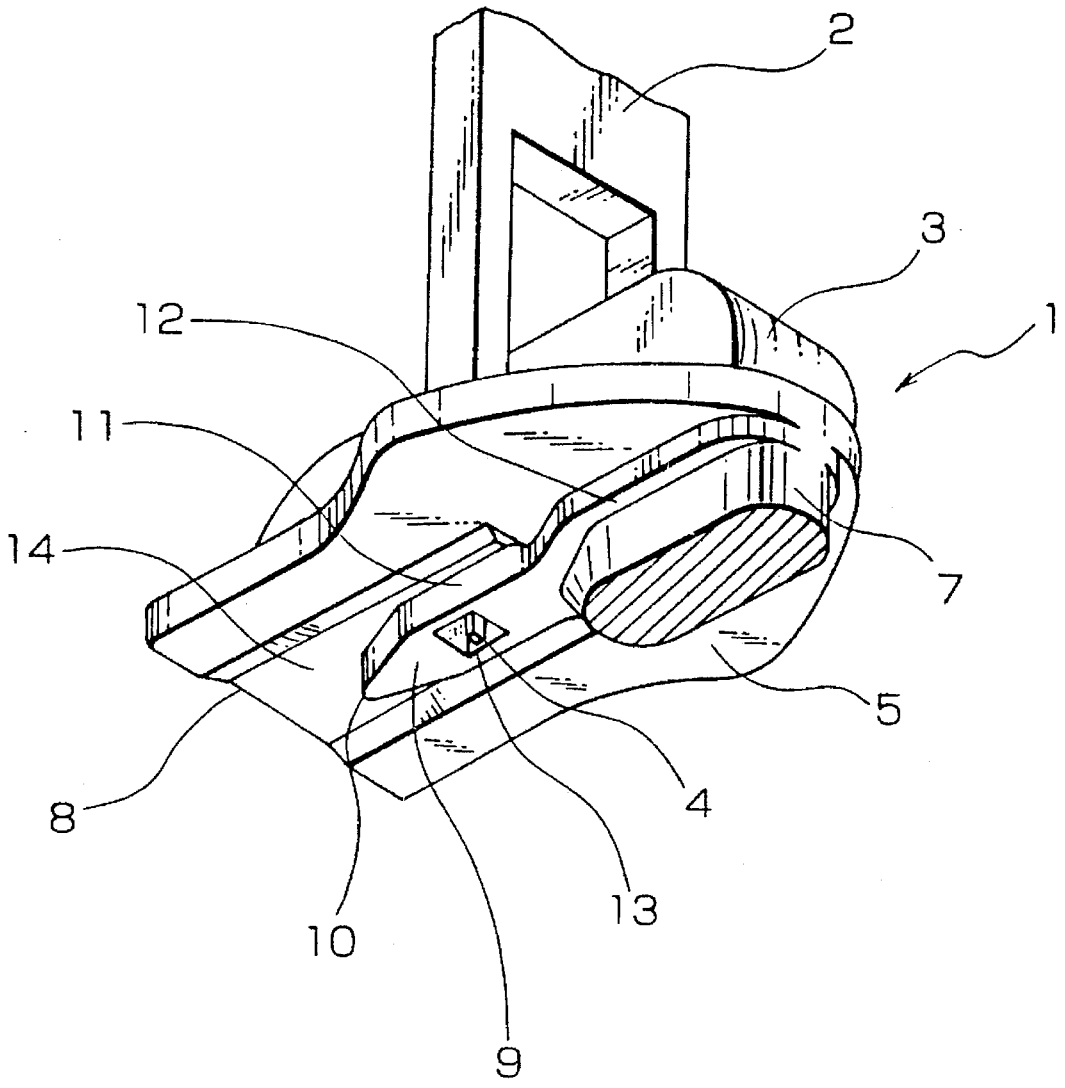
FIG. 1 is a perspective view, partly in cross section, of an automatic lock slider for a slide fastener, showing an interior surface of the upper wing of the slider.
Figure 2:
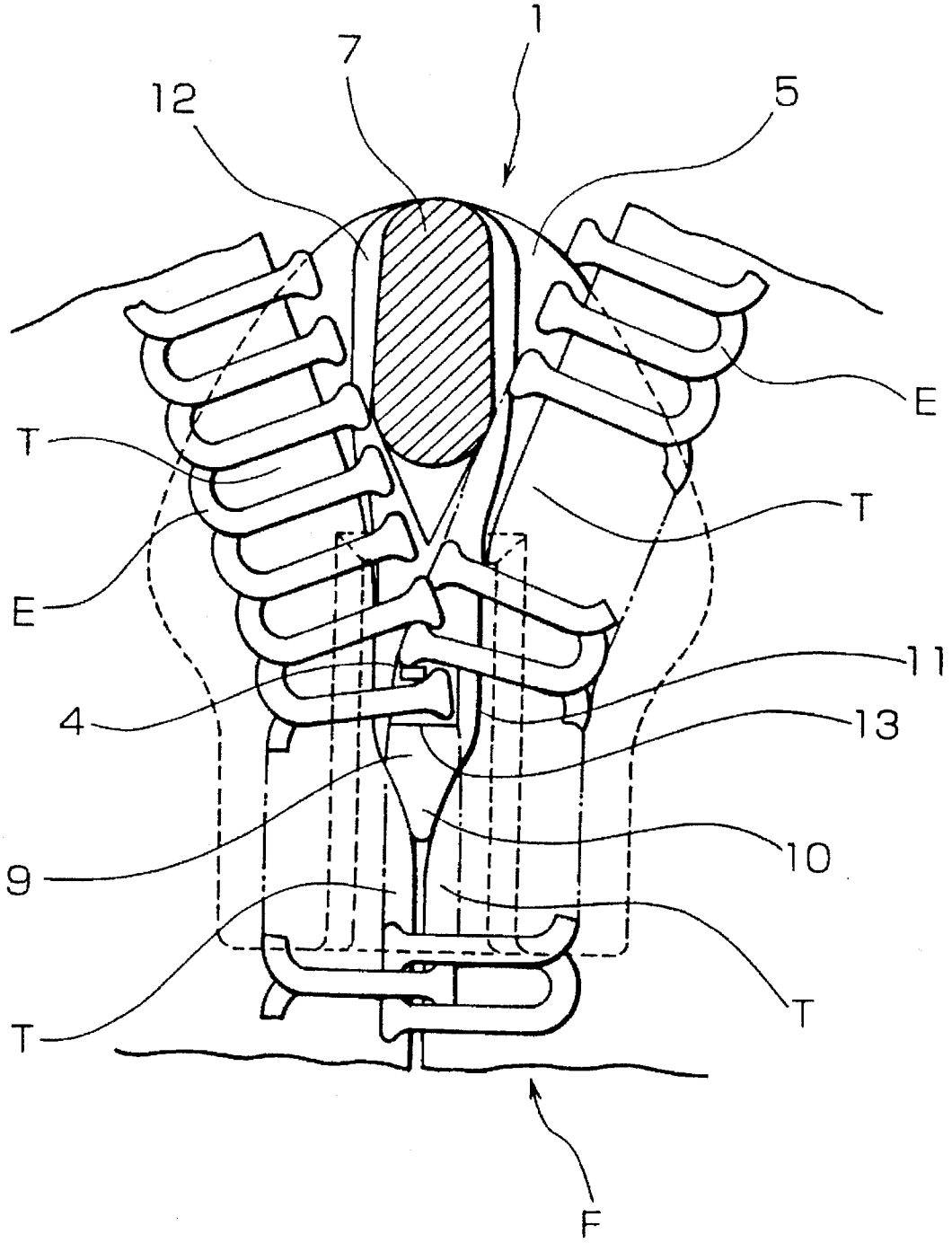
FIG. 2 is a plan view, of the slider, showing the relation between the slider and a pair of fastener stringers.
Figure 3:
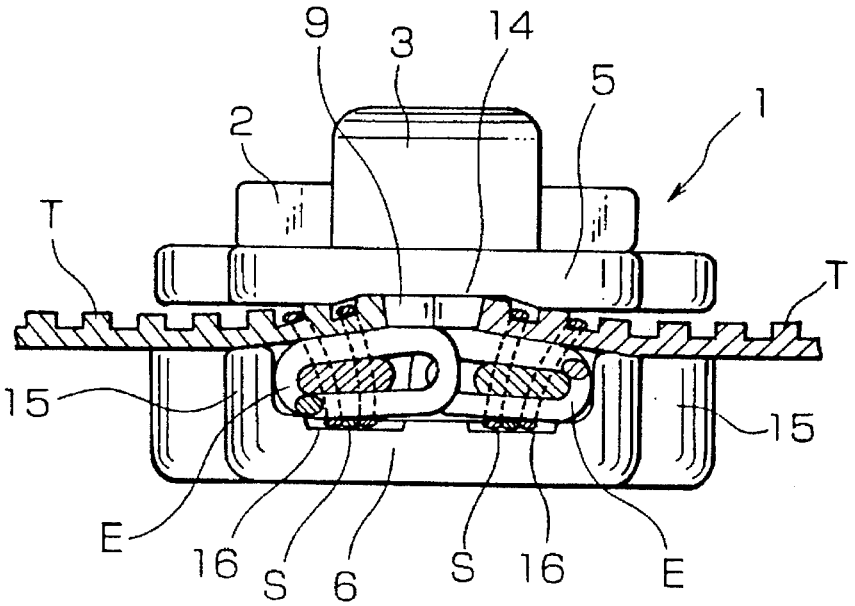
FIG 3 is a cross sectional view of the fastener chain while the slider is in use, seeing from a rear end thereof.

FIGS. 1 through 3 show a lock slider, for a slide fastener, according to a first embodiment of the present invention. The slider is an automatic lock slide-fastener slider which comprises a slider body 1, a pull tab 2, a yoke 3, and a locking pawl 4 formed from a resilient strip. The slide fastener, as shown in FIGS. 2 and 3, includes a pair of opposed fastener stringers F having a pair of rows of fastener elements E attached to a pair of stringer tapes T, T along their respective inner longitudinal edges by means of sewing threads S (FIG. 3).

The slider body 1 includes a pair of parallel spaced upper and lower wings 5, 6 joined at their front end by a guide post 7 so as to define a substantially Y-shaped guide channel between the wings 5, 6 for the passage of the opposed fastener element rows E, E of the slide fastener. As shown FIG. 1, the upper wing 5 has a plate-like configuration and includes an elongated wedge-like ridge 9 projecting from an interior surface of the upper wing 5 and extending from the guide post 7 toward and terminating short of a rear end 8 of the upper wing 5. The wedge-like ridge 9 has a uniform thickness throughout the length thereof and includes a V-shaped or tapering fore end portion 10 and both side portions 11 are formed to be parallel. The ridge 9 thus constructed can spread open the inner longitudinal edges of the fastener tapes T (FIG. 2) of the engaged fastener stringers F without difficulty and then is received between the inner longitudinal tape edges.

The upper wing 5 further has, on its interior surface, a pair of elongated narrow lands 12 contiguous to the wedge-like ridge 9 and extending along opposite sides of the guide post 7 for supporting and guiding coupling heads of the individual fastener elements E. The lands 12 and the wedge-like ridge 9 are flush with each other. An edge of the fore end portion 10 and the stem 11 of the wedge-like ridge 9 has an angle of about 90 degrees so that the wedge-like ridge 9 is reliably receivable between the inner longitudinal edges of the fastened tapes T, T.

The upper wing 5 has an aperture 13 located at an intermediate portion of the wedge-like ridge 9 for the passage of the locking pawl 4, and a recessed portion 14 formed in the interior surface of the upper wing 5 around the wedge-like ridge 9. The recessed portion 14 has a uniform width and extends from an inner end of the guide post 7 to the rear end 8 of the upper wing 5. The recessed portion 14 has sloped opposite sidewalls so that the fastener tapes T, T can readily move in a spreading direction with no substantial resistance when the closely abutting inner longitudinal tape edges are spread open by the wedge-like ridge 9.

As shown in FIG. 3, the lower wing 6 of the slider body 1 has a pair of flanges 15, 15 projecting respectively from opposite lateral edges thereof toward and terminating short of the upper wing 5 for guiding the fastener elements E, E. The lower wing 6 further has, in its interior surface, a pair of shallow grooves 16, 16 for guiding the sewing threads S or braids used to attache the fastener elements E to the fastener tapes T, T.

Figure 4:
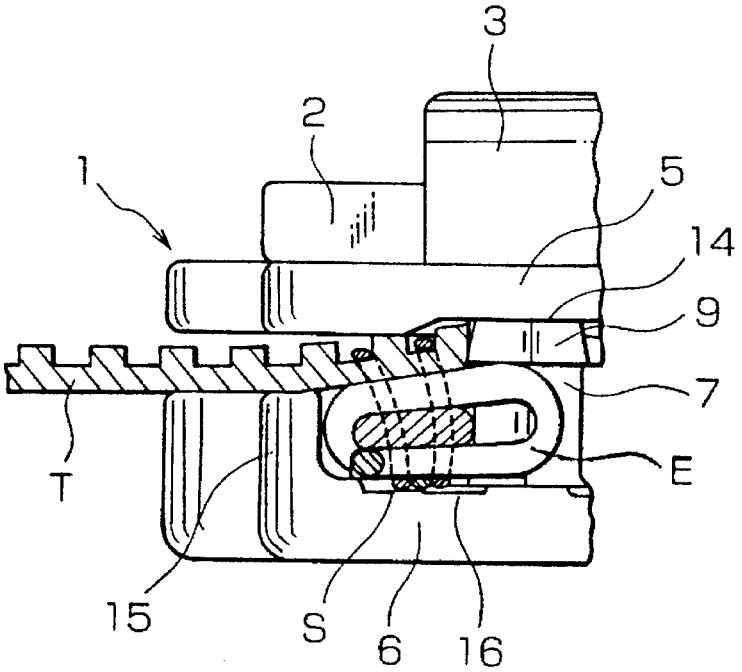
FIG. 4 is a cross-sectional view of the fastener chain with a modified lock slider.

FIG. 4 shows a modified form of the wedge-like ridge 9 projecting from the interior surface of the upper wing 5. The edge of the fore end portion and the stem 11 of the modified wedge-like ridge 9 has an acute angle. By virtue of the acute edge, the abutting inner longitudinal edges of the fastener tapes T are appropriately caught by the ridge 9 and they are spread open by the ridge 9.

Figure 5:
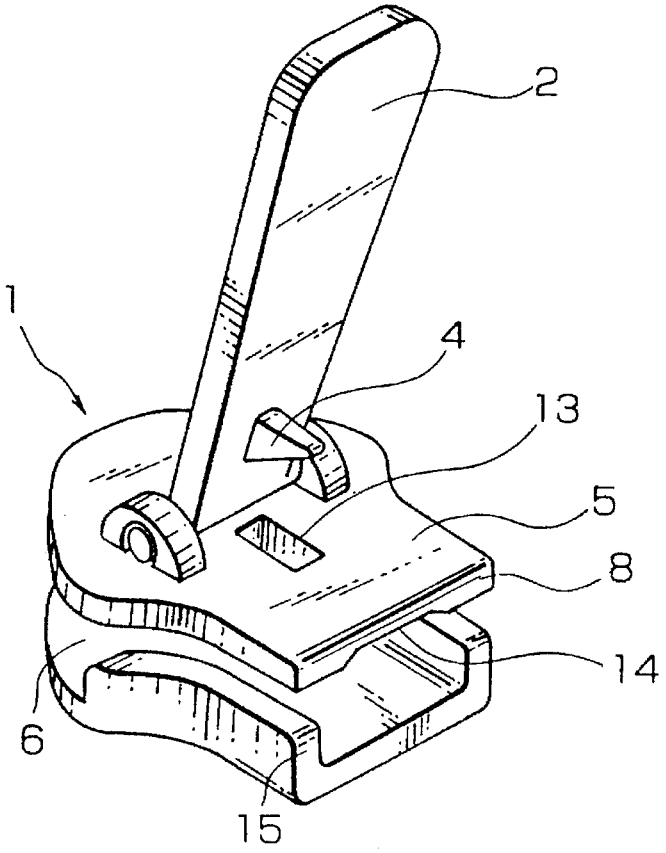
FIG. 5 is a perspective view of a lock slider for slide fastener according to another embodiment of the present invention.

FIG. 5 illustrates a manual lock slide-fastener slider having a locking pawl 4 formed integrally with a pull tab 2. The slider includes a slider body 1 having the same internal structure as the slider body 1 of any one of the lock sliders shown in FIGS. 1–3 and FIG. 4. It is, therefore, apparent that the principle (i.e., the internal structure of the slider body) of the present invention can be applied not only to the automatic lock slide-fastener sliders but also to the manual lock slide-fastener sliders.

Figure 6:
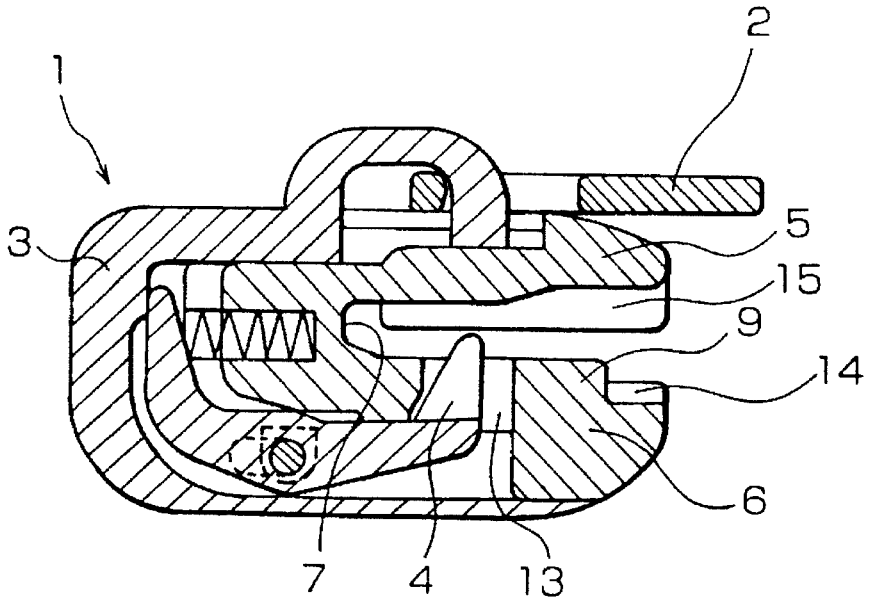
FIG. 6 is a longitudinal cross-sectional view of an automatic lock slider for slide fastener according to a further embodiment of the present invention.
Figure 7:
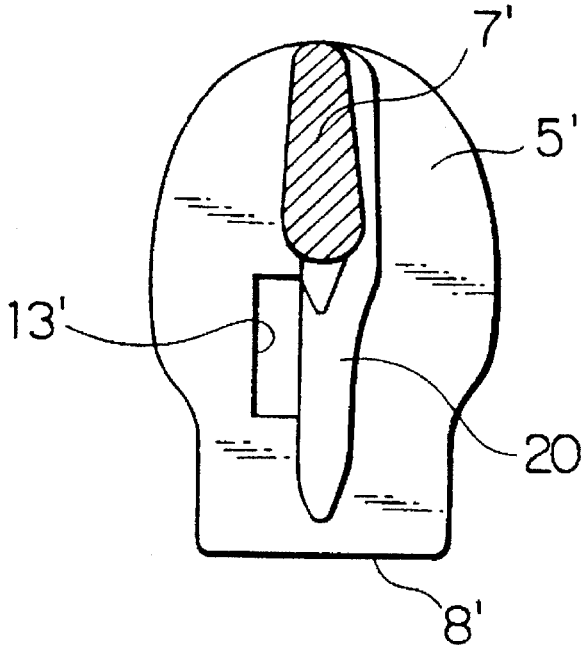
FIG. 7 PRIOR ART
FIG. 7 is a view of a conventional lock slider for slide fastener, showing an interior surface of the upper wing.
Figure 8:
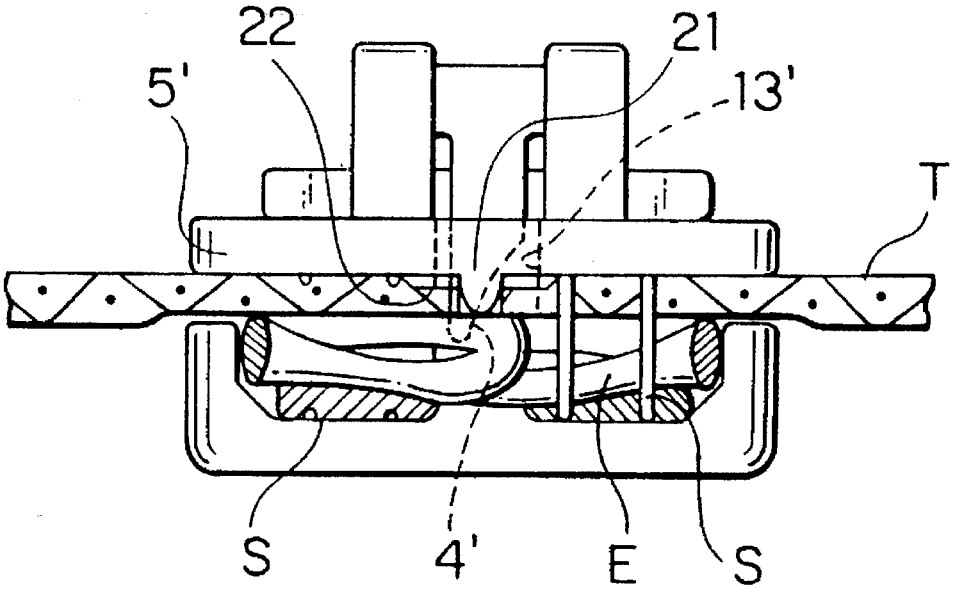
FIG. 8 PRIOR ART
FIG. 8 is a cross-sectional view of the fastener chain slider while another known lock slider is in use, seeing from a rear end thereof.
Figure 9:
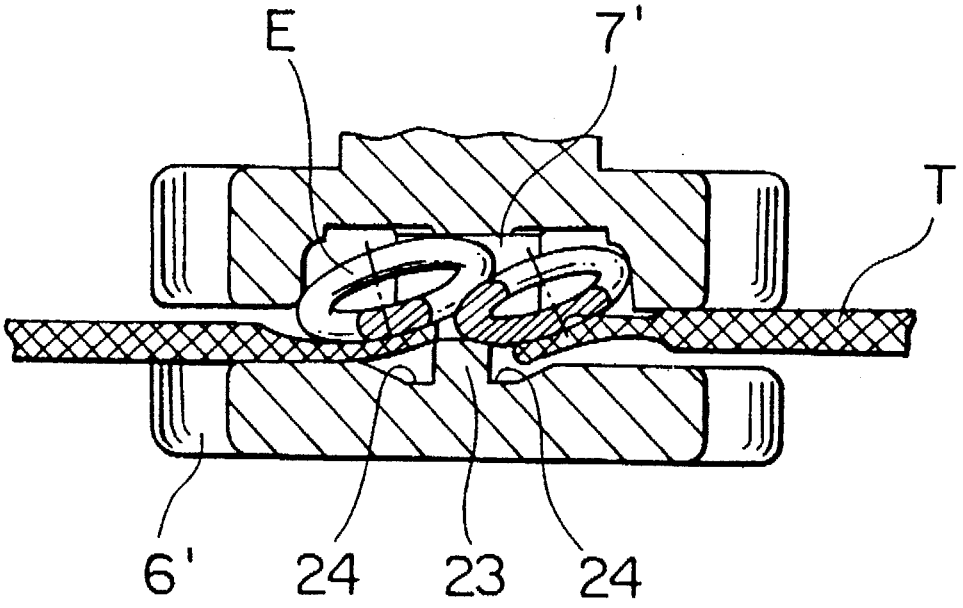
FIG. 9 PRIOR ART
FIG. 9 is a cross-sectional view of a rear end portion of still another known slider for slide fastener while in use.

The sliders described above are all lock sliders for the so-called "concealed" type slide fasteners in which the fastener tapes T are held in contact with the interior surface of the upper wing 5, and the fastener elements E are concealed by the fastener tapes T. However, as shown in FIG. 6, it is possible according to the present invention to provide the wedge-like ridge 9 and the recessed portion 14 to the lower wing 6 by reversing the internal structure of the slider. The resulting slider can be used in a slide fastener of the type in which the fastener elements are exposed to the view. In this instance, the pull tab 2 is mounted on the obverse side of the slider body 1, and the locking pawl 4 is so configured as to be operative from the back of the slider body 1. The thus constructed lock slider can be used in the general type slide fasteners.

The lock slide-fastener sliders of the foregoing construction have various advantages described below.

Since the wedge-like ridge 9 provided inside the slider sufficiently spreads open the closely abutting inner longitudinal edges of the fastener tapes T and subsequently displaces them in lateral outward directions, the locking pawl 4 is permitted to move smoothly into the slider through the aperture 13 for interlocking engagement of the fastener element rows. Thus, the slider is able to perform its prescribed locking function with reliability.

The wedge-like ridge 9 has a sharp edge, so that the fastener tapes T are no longer possible to lean over the ridge 9 or lands 12 as experienced in the conventional lock slide-fastener slider. Instead, the fastener tapes T are reliably caught or held in a laterally spaced position by the sharp-edged ridge 9 and are spread open by the ridge 9.

By virtue of the recessed portion 14 extending around the wedge-like ridge 9 provided inside the slider, the inner longitudinal edges of the fastener tapes T are allowed to be easily displaced into the recessed portion 14 when they are spread open by the wedge-like ridge 9, and a frictional resistance between the slider and the fastener tapes T is reduced and hence a smooth and reliable spreading of the inner longitudinal tape edges can be realized.

In addition, by virtue of the lands 12 disposed on opposite sides of the guide post 7 contiguously to the wedge-like ridge 9, the fastener element rows are smoothly guided in the slider so that the spreading of the inner longitudinal tape edges can be achieved smoothly. The guiding effect of the lands 12 is particularly useful when the slider is moved in the fastener closing direction.

As the recessed portion 14 extends from the guide post 7 to the rear end 8 of the slider body 1, the fastener tapes T can be smoothly introduced into the slider body, a considerable reduction in frictional force can be attained, and the inner longitudinal edges of the fastener tapes T can be spread open with utmost smoothness of lateral movement.

The lock slider of the invention is particularly suitable for use in a concealed type slide fastener because a combined tape-edge-spreading and fastener-locking mechanism (a combination of the wedge-like ridge 9 and the aperture 13 located in the ridge 9 provided in the upper wing 5) ensures that the locking pawl 4 comes into interlocking engagement with the fastener elements E only after the inner longitudinal tape edges are sufficiently spread by the ridge 9. Accordingly, the locking pawl 4 operates smoothly without interference with the inner longitudinal tape edges. The inner longitudinal tape edges are, therefore, free from damage, and the slide fastener as a whole is able to remain an attractive appearance over a prolonged period of use. This advantage is a great contrast to the problem associated with a concealed type slide fastener having the conventional lock slider in which the locking pawl is operated with the inner longitudinal tape edges spread insufficiently, causing damage to the inner longitudinal tape edges.

Obviously, various minor changes and modifications of the present invention are possible in the light of the above teaching. It is therefore to be understood that within the scope of the appended claims the invention may be practiced otherwise than as specifically described.

What is claimed is:

1. A lock slider for a slide fastener having a pair of rows of fastener elements attached to one surface of a pair of fastener tapes along their respective inner longitudinal edges, comprising:

(a) a slider body having a pair of parallel spaced upper and lower wings joined at their front end by a guide post so as to define a Y-shaped guide channel between said wings for the passage of the rows of the fastener elements of the slide fastener, one of said wings having an interior surface adapted to be in contact with the other surface of the fastener tapes;

(b) a locking pawl movable into and out of said guide channel through an aperture for interlocking engagement with the fastener elements to lock said slider in position on the slide fastener;

(c) a wedge-like ridge projecting from said interior surface of said upper or lower wing and extends from said guide post toward a rear end of said upper or lower wing for spreading open the inner longitudinal edges of the fastener tapes; and (d) said aperture for the passage of said locking pawl being located in said wedge-like ridge.

2. A lock slider according to claim 1, wherein said wedge-like ridge includes a tapering fore end portion and a rectangular stem having sharp edges and being capable to be inserted between the inner longitudinal edges of the fastener tapes.

3. A lock slider according to claim 2, wherein said wedge-like ridge has a dovetail shape in transverse cross section and is capable of holding the inner longitudinal edges of the fastener tapes in a laterally spaced position as they are spread open by said wedge-like ridge.

4. A lock slider according to claim 2, for use in a concealed type slide fastener, wherein said upper wing including said wedge-like ridge has flat opposite lateral edges free from flanges.

5. A lock slider according to claim 2, wherein a pair of lands are provided contiguous to an end of said wedge-like ridge remote from said fore end portion and extending along opposite sides of said guide post for supporting and guiding the rows of the fastener elements, respectively, said lands being flush with said wedge-like ridge.

6. A lock slider according to claim 2, wherein said upper or lower wing further bas in said interior surface a recessed portion extending around said wedge-like ridge for allowing the inner longitudinal edges of the fastener tapes to be displaced in said recessed portion.

7. A lock slider according to claim 1, wherein said wedge-like ridge has a dovetail shape in transverse cross section and is capable of holding the inner longitudinal edges of the fastener tapes in a laterally spaced position as they are spread open by said wedge-like ridge.

8. A lock slider according to claim 7, for use in a concealed type slide fastener, wherein said upper wing including said wedge-like ridge has flat opposite lateral edges free from flanges.

9. A lock slider according to claim 7, wherein a pair of lands are provided contiguous to an end of said wedge-like ridge remote from said fore end portion and extending along opposite sides of said guide post for supporting and guiding the rows of the fastener elements, respectively, said lands being flush with said wedge-like ridge.

10. A lock slider according to claim 7, wherein said upper or lower wing further has in said interior surface a recessed portion extending around said wedge-like ridge for allowing the inner longitudinal edges of the fastener tapes to be displaced in said recessed portion.

11. A lock slider according to claim 1, for use in a concealed type slide fastener, wherein said upper wing including said wedge-like ridge has flat opposite lateral edges free from flanges.

12. A lock slider according to claim 11, wherein a pair of lands are provided contiguous to an end of said wedge-like ridge remote from said fore end portion and extending along opposite sides of said guide post for supporting and guiding the rows of the fastener elements, respectively, said lands being flush with said wedge-like ridge.

13. A lock slider according to claim 11, wherein said upper or lower wing further has in said interior surface a recessed portion extending around said wedge-like ridge for allowing the inner longitudinal edges of the fastener tapes to be displaced in said recessed portion.

14. A lock slider according to claim 1, wherein a pair of lands are provided contiguous to an end of said wedge-like ridge remote from said fore end portion and extending along opposite sides of said guide post for supporting and guiding the rows of the fastener elements, respectively, said lands being flush with said wedge-like ridge.

15. A lock slider according to claim 14, wherein said upper or lower wing further has in said interior surface a recessed portion extending around said wedge-like ridge for allowing the inner longitudinal edges of the fastener tapes to be displaced in said recessed portion.

16. A lock slider according to claim 1, wherein said upper or lower wing further has in said interior surface a recessed portion extending around said wedge-like ridge for allowing the inner longitudinal edges of the fastener tapes to be displaced in said recessed portion.

17. A lock slider according to claim 16, wherein said recessed portion extends from an inner end of said guide post to a rear end of said upper or lower wing.

* * * * *